US005726375A

United States Patent [19]

Adams et al.

[11] Patent Number: 5,726,375

[45] Date of Patent: Mar. 10, 1998

[54] GUN BARREL SHROUDING SYSTEM

[75] Inventors: Nathan G. Adams, Tempe; Kal V. Geiler, Chandler, both of Ariz.

[73] Assignee: McDonnell Douglas Helicopter, Mesa, Ariz.

[21] Appl. No.: 662,603

[22] Filed: Jun. 13, 1996

[51] Int. Cl.[6] ..... F41A 13/00; F41A 21/00; F41A 29/00

[52] U.S. Cl. ..... 89/14.1

[58] Field of Search ..... 89/14.1

[56] References Cited

U.S. PATENT DOCUMENTS

| | | | |
|---|---|---|---|
| 1,919,242 | 7/1933 | Moore | 89/14.1 |
| 1,963,086 | 6/1934 | Green | 89/14.1 |
| 2,086,520 | 7/1937 | Baumann | 89/14.1 |
| 2,126,792 | 8/1938 | MacGregor | 89/14.1 |
| 2,221,905 | 11/1940 | Berlin | 89/14.1 X |
| 2,273,839 | 2/1942 | DePort et al. | 89/14.1 |
| 2,287,066 | 6/1942 | Rogers | 89/14.1 X |
| 2,427,374 | 9/1947 | Walker | 89/14.1 |
| 2,467,372 | 4/1949 | De Permentier | 89/14.1 |
| 2,478,950 | 8/1949 | Spurling | 89/14.1 |
| 2,935,912 | 5/1960 | Hartley | 89/14.1 |
| 4,535,676 | 8/1985 | Politzer et al. | 89/14.1 |
| 4,663,875 | 5/1987 | Tatro | 89/14.1 X |
| 4,762,048 | 8/1988 | Higashi et al. | 89/14.1 |
| 4,841,836 | 6/1989 | Bundy | 89/14.1 |
| 4,982,648 | 1/1991 | Bol et al. | 89/14.1 |
| 5,062,346 | 11/1991 | Greve Hansen et al. | 89/14.1 |
| 5,400,691 | 3/1995 | Suttie et al. | 89/14.1 |

*Primary Examiner*—Daniel T. Pihulic
*Assistant Examiner*—Matthew J. Lattig
*Attorney, Agent, or Firm*—Donald E. Stout

[57] ABSTRACT

A gun barrel shrouding system is capable of significantly reducing the infrared signature of a gun barrel, without directly cooling the gun barrel. A shroud is placed around the gun barrel, but the shroud does not contact the gun barrel. Air is circulated through the shroud to cool the shroud itself, but the very hot gun barrel is only partially cooled by the air as the air exits from the shroud. Since the shroud does not contact the gun barrel, the shroud may be manufactured of a lightweight and simple design, and the recoil action of the gun barrel upon firing do not need to be compensated for by the shroud.

27 Claims, 3 Drawing Sheets

GUN BARREL SHROUDING SYSTEM

The U.S. Government has a paid-up license in this invention and the right in limited circumstances to require the patent owner to license others on reasonable terms as provided for by the terms of Contract No. DAAJ02-94-C-0035 awarded by the U.S. Department of Defense (Army).

FIELD OF THE INVENTION

The present invention relates generally to a cooling arrangement for a gun barrel and, more particularly, to an air-cooled shrouding system for hiding a hot gun barrel from infrared detectors.

BACKGROUND OF THE INVENTION

When a gun barrel is fired, heat is generated from the propulsive force used to accelerate the projectile and from friction between the projectile and an interior surface of the gun barrel. The hot gun barrel emits infrared radiation, which can be detected by an infrared detector to determine the location of the gun barrel. A rapid fire machine gun, for example, can provide an offensive advantage in battle, but unless the infrared signature of this gun barrel is substantially attenuated, the rapid fire machine gun can present an easy target for an enemy infrared detector. Since the hot gun barrel can be detected by an infrared radiation detector, the prior art has sought to implement systems for effectively cooling the gun barrel.

Many complex prior art apparatuses have been implemented in attempts to efficiently cool a hot gun barrel. U.S. Pat. No. 2,126,792 to MacGregor discloses a gun barrel cooling apparatus, which harnesses the expansion of a compressed gas to accomplish heat transfer from the gun barrel. The system requires an inner cylinder, an intermediate cylinder, and an outer cylinder, in addition to an air expansion chamber and a pressurized gas, such as carbon dioxide. U.S. Pat. No. 4,982,648 issued to Bol et al. discloses an arrangement for cooling the gun barrel of a combat tank. Cooling channels are formed within the outer surface of the gun barrel itself, and air is circulated through these channels to cool the gun barrel. The cooling channels reduce the infrared signature of the gun barrel during combat, and further protect the gun barrel from deformation or excessive heating resulting from solar radiation. While this cooling system is not as complex in design as that of the U.S. Pat. No. 2,126,792, this cooling system requires a thick gun barrel, such as the gun barrel of a tank, for accommodating the channels therein. The weight of this gun barrel would prohibit efficient use on an aircraft, and, further, the design of this cooling system would require a large flow of air through the channels to substantially reduce the infrared signature of the gun barrel.

Other cooling systems have been proposed specifically for use on aircraft, but these cooling systems are similar to the above-described patents in that they focus on cooling the gun barrel itself to thereby extend the life of the gun barrel and to facilitate the firing of more rounds per burst. U.S. Pat. No. 2,273,839 to T. De Port et al, for example, discloses an air-cooled gun barrel for use on an aircraft. When the aircraft travels in the forward direction, air passes over the gun barrel to cool the gun barrel. Another patent, U.S. Pat. No. 2,221,905 to Berlin, discloses a similar apparatus. Both of these gun barrel cooling apparatuses require forward movement of the aircraft to facilitate cooling of the gun barrel. A need has existed in the prior art for a device of simple construction, which can effectively reduce the infrared signature of a gun barrel on an aircraft even when the aircraft is not moving in a forward direction. Such a device would especially be adaptable for use on a helicopter.

SUMMARY OF THE INVENTION

The gun barrel shrouding system of the present invention is capable of significantly reducing the infrared signature of a gun barrel, without directly cooling the gun barrel. A shroud is placed around the gun barrel, but the shroud preferably does not contact the gun barrel. Air is circulated through the shroud to cool the shroud itself, but the very hot gun barrel is only partially cooled by the air as the air exits from the shroud. Since the shroud does not contact the gun barrel, the shroud may be manufactured of a lightweight and simple design, and the recoil action of the gun barrel upon firing does not need to be compensated for by the shroud.

The gun barrel shrouding system includes a first shroud wall adapted to fit around the gun barrel, and a second shroud wall adapted to fit around the first shroud wall. A first air chamber is defined between an outer surface of the gun barrel and the first shroud wall, and a second air chamber is defined between the first shroud wall and the second shroud wall. A fan is used to circulate air between the first air chamber and the second air chamber and, more particularly, from the second air chamber to the first air chamber.

Since an object of the present invention is to cool the shrouding system itself, instead of the gun barrel, the air is circulated through the second air chamber before passage into the first air chamber. Thus, the gun barrel shrouding system has a primary purpose of cooling the first shroud wall, and this first shroud wall does not get as hot as the gun barrel. Accordingly, the first shroud wall may be reduced in temperature much more than the gun barrel, with a smaller flow of air.

According to another feature of the present invention, a plurality of fins are disposed between the first shroud wall and the second shroud wall for dissipating heat therefrom as air flows thereover. The fins are preferably attached to both the first and the second shroud walls. A plurality of apertures are disposed within the first shroud wall for allowing air to pass from the second air chamber into the first air chamber. The fan circulates the air from a proximal portion of the gun barrel shrouding system to a distal portion of the gun barrel shrouding system. After the air passes through the plurality of apertures in the first shroud wall, some of the air contacts the hot gun barrel, and flows toward both the proximal end of the gun barrel shrouding system and the distal end of the gun barrel shrouding system. The air then exits from the two ends of the gun barrel shrouding system. The gun barrel shrouding system of the present invention is lightweight and may be assembled over existing gun barrels with relative ease.

Since the gun barrel shrouding system does not directly contact the existing gun barrel, the gun barrel shrouding system does not have to be engineered to withstand recoils resulting from firing of the gun barrel. Additionally, the first chamber of air between the gun barrel and the first shroud wall provides insulation between the first and second shroud walls and the gun barrel. Since a fan is used to circulate air between the first and second shroud walls, the gun barrel shrouding system is capable of effectively reducing the infrared signature of a gun barrel, even when the aircraft using the gun barrel is not travelling with a horizontal velocity. A helicopter, for example, would especially benefit from the gun barrel shrouding system when in a hovering mode. The gun barrel shrouding system of the present invention is also applicable to small caliber guns, such as that on the Bradley Fighting Machine, for example.

The present invention, together with additional features and advantages thereof, may best be understood by reference to the following description taken in connection with the accompanying illustrative drawings.

DETAILED DESCRIPTION OF THE PREFERRED EMBODIMENT

Figure 1:
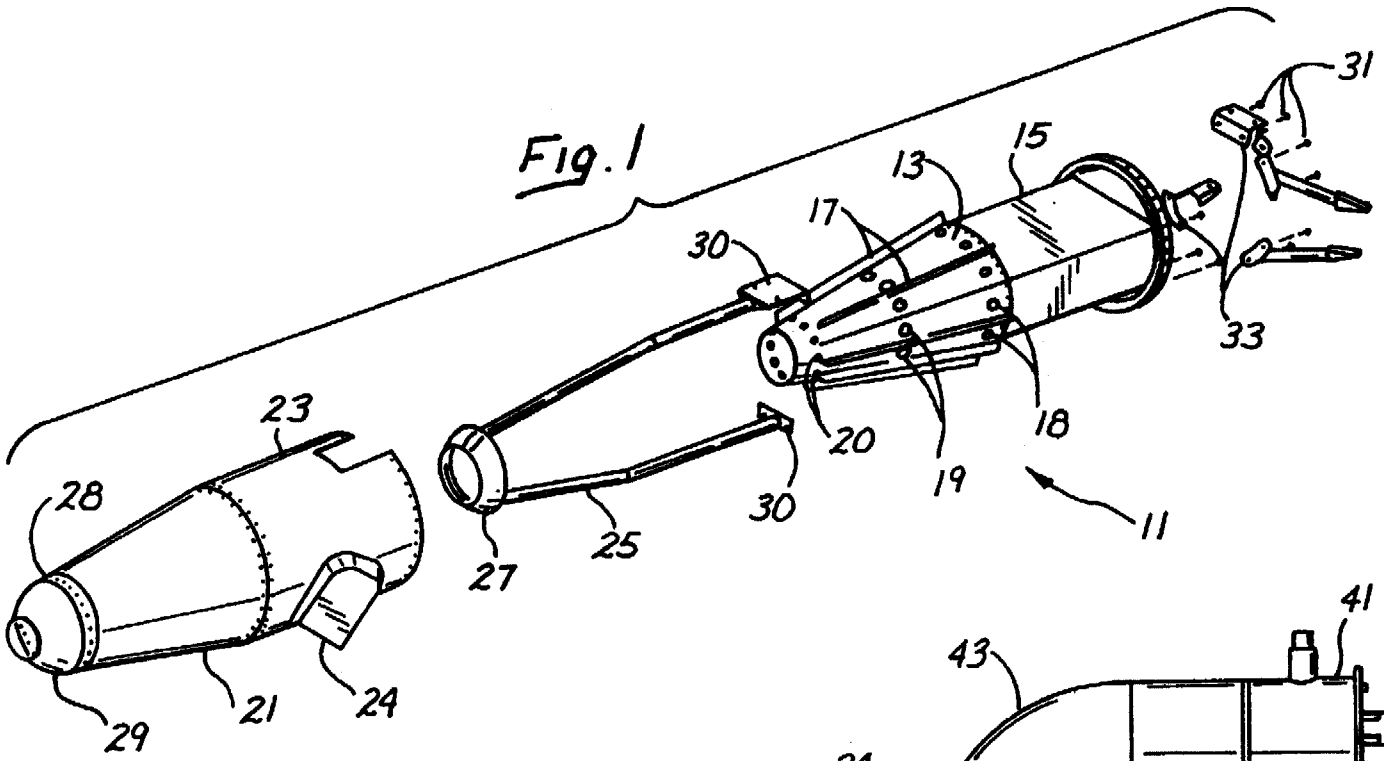
FIG. 1 is an exploded view of the gun barrel shrouding system according to the presently preferred embodiment.

Turning to FIG. 1, the gun barrel shrouding system 11 is illustrated in a partially disassembled fashion. The gun barrel shrouding system 11 comprises a first shroud wall 13 connected to an inner plenum wall 15. The first shroud wall 13 is preferably cone shaped, and the inner plenum wall 15 is preferably rectangularly shaped. The first shroud wall 13 comprises a plurality of fins 17, and further comprises apertures 18, 19, and 20. A second shroud wall 21 is connected to both the plurality of fins 17 and to an outer plenum wall 23. Similarly to the first shroud wall 13 and the inner plenum wall 15, the second shroud wall 21 is preferably cone shaped, and the outer plenum wall 23 is preferably tubularly shaped.

In the presently preferred embodiment, a wire strike assembly 25 fits between the first shroud wall 13 and the second shroud wall 21. The wire strike assembly 25 comprises an annular portion 27 for contacting an inner surface of the tapered tip 29, and further comprises two securing brackets 30. The support brackets 33 and mounting bolts 31 secure the inner plenum wall 15 and first shroud wall 13 to the aircraft (not shown). The two securing brackets 30 of the wire strike assembly 25 are secured to the support brackets 33.

In the presently preferred embodiment, the gun barrel shrouding system 11 significantly reduces the infrared radiation contributed to a hot gun barrel mounted on an aircraft. The gun barrel may be used in conjunction with a chain gun, for example. The hardware shown in FIG. 1 is preferably relatively lightweight and simple in design. This hardware may be installed around existing gun barrels to thereby shield these gun barrels from detection by infrared radiation detectors. In the presently preferred embodiment, the hardware shown in FIG. 1 can be attached to the gun turret of an existing helicopter at the same points where a conventional wire strike assembly is secured. Thus, the conventional wire strike assembly may be removed, and the gun barrel shrouding system 11 may be installed in place of the wire strike assembly.

The gun barrel shrouding system 11 of the presently preferred embodiment includes a wire strike assembly 25. This wire strike assembly 25 has a function of diverting wires and other debris in a radial direction toward a cutter assembly (not shown), which may be secured to the securing brackets 30. The first shroud wall 13 and the second shroud wall 21 are formed in a cone shape to facilitate implementation of the wire strike assembly 25. In other embodiments, however, the first shroud wall 13 and the second shroud wall 21 may be either tubular or rectangular, for example, with either consistent or different cross-sectional dimensions. For example, the diameter of the second shroud wall 21 may be uniformly equal to the diameter of the portion 28 shown in FIG. 1, or may be uniformly the diameter of the outer plenum wall 23. Additionally, although the inner plenum wall 15 is preferably rectangularly shaped to accommodate hardware of the chain gun of the presently preferred embodiment, the size and configuration of this inner plenum wall 15 may be changed according to preference.

When the second shroud wall 21 and outer plenum wall 23 are fitted over the first shroud wall 13 and the inner plenum wall 15, a second air chamber is formed therebetween. When the gun barrel shrouding system 11 is placed over a gun barrel, a first air chamber is formed between the first shroud wall 13 and the inner plenum wall and gun barrel itself.

Figure 2:
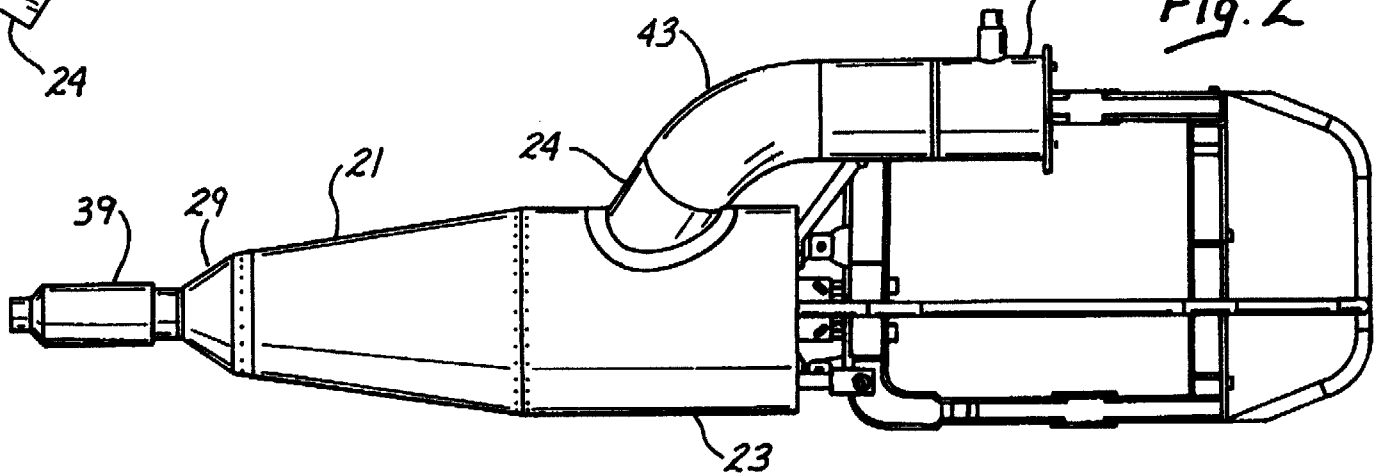
FIG. 2 is a bottom view of the gun barrel shrouding system according to the presently preferred embodiment.

FIG. 2 illustrates a bottom view of the gun barrel shrouding system 11 assembled over a gun barrel. Only the flash suppressor or muzzle break 39 of the gun barrel protrudes from the gun barrel shrouding system 11. A fan 41 circulates air through the flex air duct 43 and into the air duct fitting 24 of the outer plenum wall 23.

Figure 3:
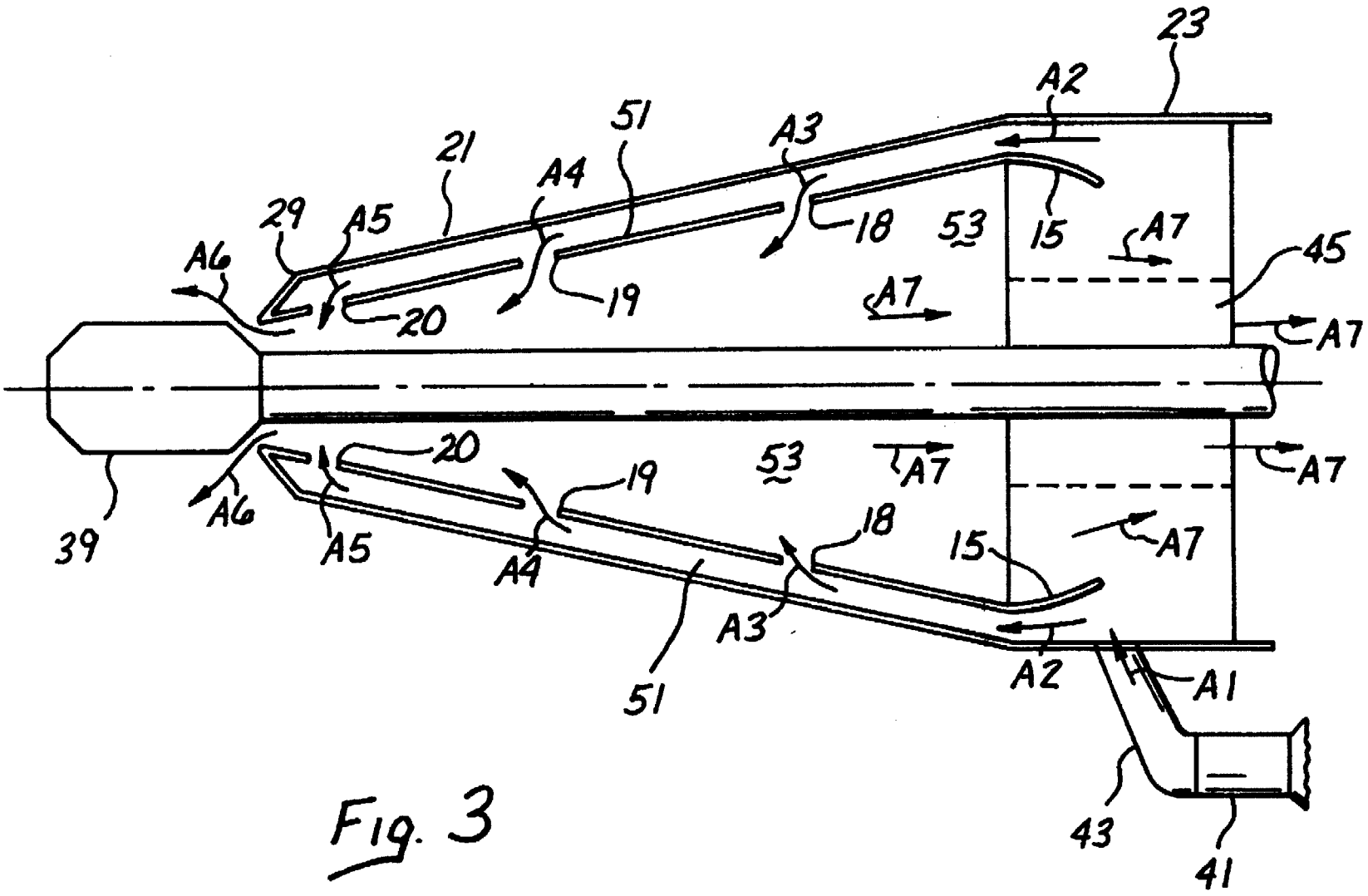
FIG. 3 is a schematic cross-sectional view illustrating air flow of the gun barrel shrouding system of the present invention.

The schematic diagram shown in FIG. 3 illustrates the circulation of air from the fan 41 through the second and first air chambers. Air from the fan 41 travels in the direction of arrow A1 (FIG. 3) into the second air chamber. After exiting the flex air duct 43 in the direction of the arrow A1, the air enters the second air chamber 51 in the direction of the arrows A2. The air circulates from this proximal portion of the second air chamber 51 toward a distal portion of the second air chamber 51 located near the muzzle brakes 39 of the gun barrel.

The air travelling toward the muzzle brake 39 in the direction of the arrows A2 exits through the first apertures 18, the second apertures 19, and the third apertures 20, as shown by the arrows A3, A4, and A5, respectively. The first apertures 18, the second apertures 19, and the third apertures 20 are preferably sized to engineer predetermined portions of air therethrough to thereby maximize cooling of the second shroud wall 21, for example.

In the presently preferred embodiment, when the helicopter is in the hover mode, an approximately equal percentage of air exiting through the second air chamber 51 travels in the direction of the arrows A6 to exit over the muzzle brake 39, and another equal percentage of the air travels in the direction of arrow A7 to exit through the air exit path 45.

Since the first shroud wall 13 and the second shroud wall 21 do not contact the gun barrel, the gun barrel is allowed to recoil without any significant effect on the gun barrel shrouding system 11. Air circulating over the muzzle brake 39 in the direction of the arrows A6 helps cool this area of the gun barrel. In the presently preferred embodiment, an additional thermal barrier coating is applied to the exterior surface of both the second shroud wall 21 and the outer plenum wall 23 to further reduce any infrared radiation that may be emitted therefrom.

A pressure is maintained within the gun barrel shrouding system 11 by the fan 41, and the air exiting at the arrows A6 and A7 returns to an approximately ambient pressure. According to the presently preferred embodiment, the fins 17 of the first shroud wall 13 and the second shroud wall 21 dissipate heat from both the first shroud wall 13 and the second shroud wall 21 into the circulating air in the first air chamber 53. The heat transfer and infrared radiation signature control mechanisms of the present invention include radiation of heat from the hot gun barrel to the underside of the first shroud wall 13, conduction of heat into the fins 17 and into the second shroud wall 21, and additional convection of the heat into the air circulating first through the second air chamber 51 and then through the first air chamber 53 to ambient.

Figure 4:
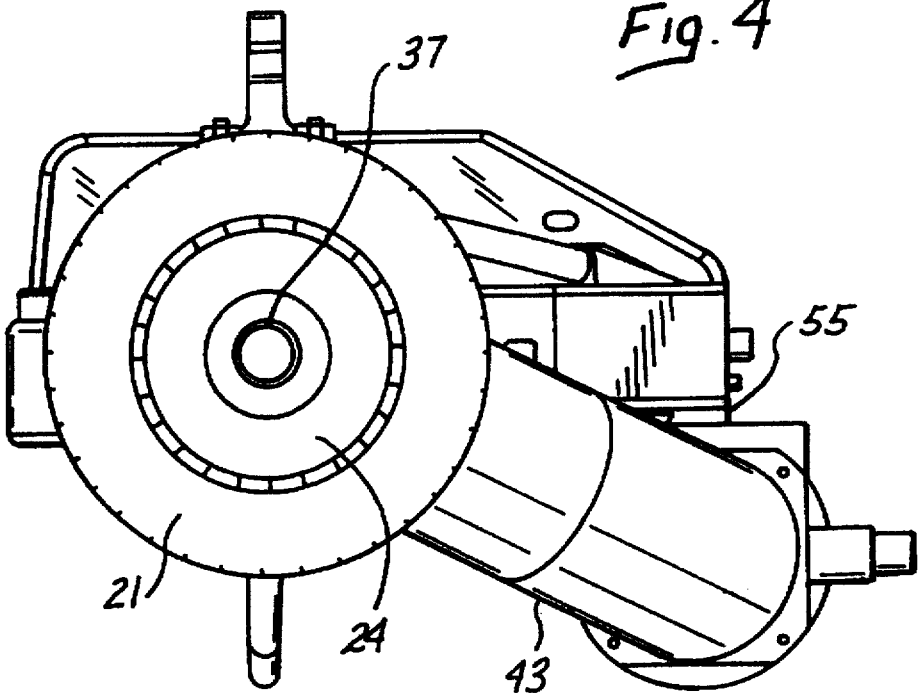
FIG. 4 is a front view of the gun barrel shrouding system according to the presently preferred embodiment.
Figure 5:
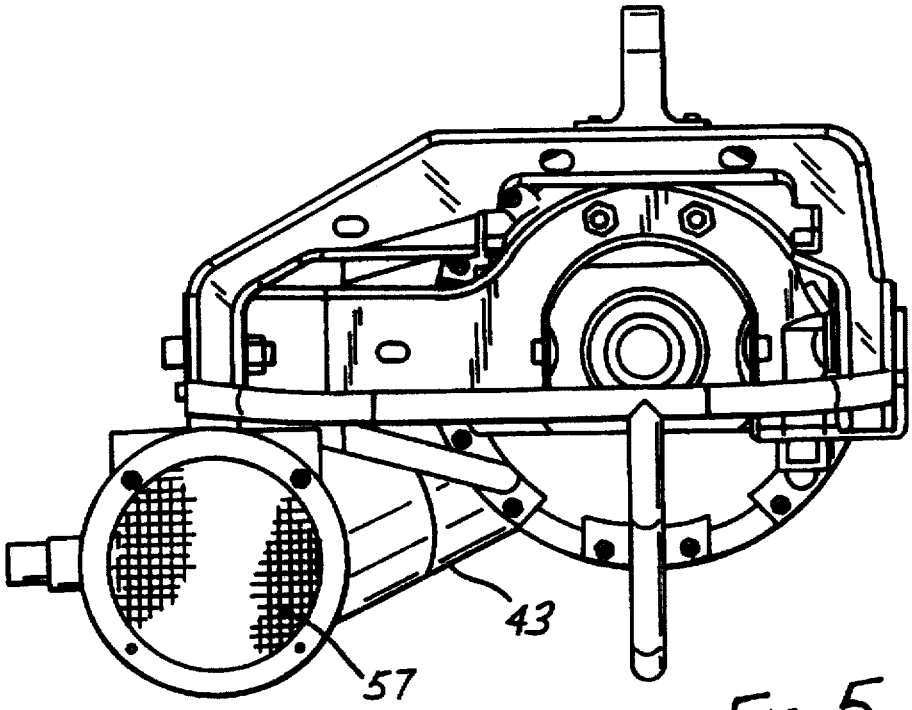
FIG. 5 is a rear view of the gun barrel shrouding system according to the presently preferred embodiment.

FIG. 4 illustrates a front view of the gun barrel shrouding system 11 installed over a gun barrel, and FIG. 5 illustrates a rear view of this assembly. The fan mount 55 secures the fan 41 to the aircraft, and the fan intake screen 57 allows for filtering of the intake air before passage through the second air chamber 51 and the first air chamber 53.

Although an exemplary embodiment of the invention has been shown and described, many other changes, modifications and substitutions, in addition to those set forth in the above paragraph, may be made by one having ordinary skill in the art without necessarily departing from the spirit and scope of this invention.

We claim:

1. A gun barrel shrouding system for shielding a hot gun barrel from detection by an infrared detector, the gun barrel shrouding system comprising:

a first shroud wall having a length and being adapted to fit around and form a first air chamber around a gun barrel;

a second shroud wall adapted to fit around the length of the first shroud wall, wherein a second air chamber is defined between the length of the first air chamber and the second air chamber to thereby cool the second shroud wall; and a fan adapted for circulating air between the first air chamber and the second air chamber.

2. The gun barrel shrouding system according to claim 1, wherein a plurality of fins are disposed between the first shroud wall and the second shroud wall.

3. The gun barrel shrouding system according to claim 1, wherein the first shroud wall is substantially tubularly shaped, and wherein the second shroud wall is substantially tubularly shaped.

4. The gun barrel shrouding system according to claim 1, wherein the first shroud wall is conically shaped, and wherein the second shroud wall is conically shaped.

5. The gun barrel shrouding system according to claim 4, wherein the first shroud wall comprises a proximal first shroud wall end and a distal first shroud wall end, and wherein a diameter of the first shroud wall near the proximal first shroud wall end is greater than a diameter of the first shroud wall near the distal first shroud wall end.

6. The gun barrel shrouding system according to claim 5, wherein the second shroud wall comprises a proximal second shroud wall end and a distal second shroud wall end, and wherein a diameter of the second shroud wall near the proximal second shroud wall end is greater than a diameter of the second shroud wall near the distal second shroud wall end.

7. The gun barrel shrouding system according to claim 1, wherein the first shroud wall comprises a plurality of apertures disposed along the length of the first shroud wall for allowing air to pass between the first air chamber and the second air chamber.

8. The gun barrel shrouding system according to claim 7, wherein air is circulated from the second air chamber into the first air chamber through the plurality of apertures.

9. The gun barrel shrouding system according to claim 8, wherein the gun barrel comprises a proximal gun barrel end and a distal gun barrel end, and wherein air is circulated over both the proximal gun barrel end and over the distal gun barrel end.

10. The gun barrel shrouding system according to claim 9, wherein air exits the first air chamber near both the proximal gun barrel end and the distal gun barrel end.

11. The gun barrel shrouding system according to claim 10, wherein the gun barrel is a lightweight gun barrel for use on one of an aircraft and a ground vehicle.

12. The gun barrel shrouding system according to claim 11, wherein the aircraft is a helicopter.

13. The gun barrel shrouding system according to claim 12, wherein substantially half of the air exiting from the air chamber exits near the proximal gun barrel end and substantially half of the air exiting from the air chamber exits near the distal gun barrel end, when a horizontal travelling velocity of the helicopter is substantially zero.

14. A gun barrel shrouding system for shielding a hot gun barrel from detection by an infrared detector, the gun barrel having both a proximal gun barrel end and a distal gun barrel end, the gun barrel shrouding system comprising:

a plenum adapted to fit around the proximal gun barrel end, the plenum surrounding a portion of the proximal gun barrel end and having an air pressure greater than an ambient air pressure;

a first shroud wall adapted to be disposed around the gun barrel between the proximal gun barrel end and the distal gun barrel end, the first shroud wall forming a first air chamber between the gun barrel and the first shroud wall; and a second shroud wall adapted to fit concentrically around the first shroud wall and to be disposed around the distal gun barrel end, wherein air from within the plenum is routed between the first shroud wall and the second shroud wall, cooling the first shroud wall and the second shroud wall, to thereby reduce an infrared signature of the second shroud wall.

15. The gun barrel shrouding system according to claim 14, wherein the first shroud wall does not contact the gun barrel.

16. The gun barrel shrouding system according to claim 15, wherein a second air chamber is formed between the first shroud wall and the second shroud wall, and wherein air is circulated from the plenum to the second air chamber, and from the second air chamber to the first air chamber.

17. The gun barrel shrouding system according to claim 16, further comprising a fan for generating the air pressure in the plenum.

18. A gun barrel shrouding system, comprising:

a gun barrel having a proximal end, a distal end, an inner gun barrel surface, and an outer gun barrel surface;

a first shroud wall having a length and being disposed concentrically around the gun barrel;

a first air chamber located between the outer gun barrel surface and the first shroud wall;

a second shroud wall disposed concentrically around the length of the first shroud wall;

a second air chamber located between the length of the first shroud wall and the second shroud wall; and a fan adapted for circulating air between the first air chamber and the second air chamber, wherein air can be circulated between the first air chamber and the second air chamber to thereby cool the second shroud wall and reduce an infrared signature of the second shroud wall.

19. A gun barrel shrouding system for shielding a hot gun barrel from detection by an infrared detector, the gun barrel having both a proximal gun barrel end and a distal gun barrel end, the gun barrel shrouding system comprising:

a plenum adapted to fit around the proximal gun barrel end, the plenum surrounding a portion of the proximal gun barrel end and having an air pressure greater than an ambient air pressure;

a first shroud wall adapted to fit around the distal gun barrel end, the first shroud wall forming a first air chamber between the distal gun barrel end and the first shroud wall; and a second shroud wall adapted to fit concentrically around the first shroud wall, wherein air from within the plenum is routed between the first shroud wall and the second shroud wall, cooling the first shroud wall and the second shroud wall, to thereby reduce an infrared signature of the second shroud wall.

20. The gun barrel shrouding system according to claim 19, wherein the first shroud wall is adapted to be connected to the plenum.

21. The gun barrel shrouding system according to claim 19, wherein the plenum comprises a proximal plenum end and a distal plenum end, and wherein the first shroud wall is adapted to be connected to the distal plenum end.

22. A gun barrel shrouding system for shielding a hot gun barrel from detection by an infrared detector, the gun barrel having both a proximal gun barrel end and a distal gun barrel end, the gun barrel shrouding system comprising:

a plenum adapted to fit around the proximal gun barrel end, the plenum surrounding a portion of the proximal gun barrel end and having an air pressure greater than an ambient air pressure;

a first shroud wall adapted to be disposed around the gun barrel between the proximal gun barrel end and the distal gun barrel end, the first shroud wall having a length and forming a first air chamber between the gun barrel and the first shroud wall; and a second shroud wall adapted to fit concentrically around the first shroud wall and to be disposed around the distal gun barrel end, wherein air from within the plenum is routed between the first shroud wall and the second shroud wall along the length of the first shroud wall, cooling the first shroud wall and the second shroud wall, to thereby reduce an infrared signature of the second shroud wall.

23. The gun barrel shrouding system according to claim 22, wherein the first shroud wall is adapted to be connected to the plenum.

24. The gun barrel shrouding system according to claim 22, wherein the plenum comprises a proximal plenum end and a distal plenum end, and wherein the first shroud wall is adapted to be connected to the distal plenum end.

25. A gun barrel shrouding system for shielding a hot gun barrel from detection by an infrared detector, the gun barrel shrouding system comprising:

a first shroud wall having a length and being adapted to fit around and form a first air chamber around a gun barrel;

a second shroud wall adapted to fit around the length of the first shroud wall, wherein a second air chamber is defined between the length of the first air chamber and the second air chamber to thereby cool the second shroud wall; and a plurality of fins disposed between the first shroud wall and the second shroud wall.

26. The gun barrel shrouding system according to claim 25, wherein each of the plurality of fins protrudes from an outer surface of the first shroud wall, and wherein each of the plurality of fins is oriented in a direction that is substantially parallel with the gun barrel.

27. The gun barrel shrouding system according to claim 26, wherein neither the first shroud wall nor the second shroud wall contacts the gun barrel.

* * * * *